US006682184B2

(12) United States Patent
Anderson et al.

(10) Patent No.: US 6,682,184 B2
(45) Date of Patent: Jan. 27, 2004

(54) SEPTUM SEAL PLUG USED IN INKJET CARTRIDGE

(75) Inventors: Stephen A. Anderson, Thompson Station, TN (US); Carl D. Massey, Tomball, TX (US); Patrick D. Carter, Fairview, TN (US); William A. Putman, Franklin, TN (US); Bruce S. Jones, Franklin, TN (US)

(73) Assignee: Seiko Epson Corporation, Nagano-Ken (JP)

( * ) Notice: Subject to any disclaimer, the term of this patent is extended or adjusted under 35 U.S.C. 154(b) by 0 days.

(21) Appl. No.: 10/148,983

(22) PCT Filed: Oct. 5, 2001

(86) PCT No.: PCT/US01/31265

§ 371 (c)(1),
(2), (4) Date: Jun. 4, 2002

(87) PCT Pub. No.: WO02/28647

PCT Pub. Date: Apr. 11, 2002

(65) Prior Publication Data

US 2002/0180848 A1 Dec. 5, 2002

Related U.S. Application Data

(60) Provisional application No. 60/239,085, filed on Oct. 6, 2000.

(51) Int. Cl.[7] ..... B41J 2/175

(52) U.S. Cl. ..... 347/86

(58) Field of Search ..... 347/84–87; 141/110

(56) References Cited

U.S. PATENT DOCUMENTS

| | | | | | |
|---|---|---|---|---|---|
| 5,119,115 | A | | 6/1992 | Buat et al. | 346/140 |
| 5,221,935 | A | * | 6/1993 | Uzita | 347/86 |
| 5,801,737 | A | * | 9/1998 | Sato et al. | 347/86 |
| 5,946,014 | A | * | 8/1999 | Shimomura et al. | 347/87 |
| 6,048,055 | A | * | 4/2000 | Hakkaku | 347/86 |
| 6,238,042 | B1 | * | 5/2001 | Kobayashi et al. | 347/86 |

* cited by examiner

*Primary Examiner*—Shih-Wen Hsieh
*Assistant Examiner*—An H. Do
(74) *Attorney, Agent, or Firm*—Squire, Sanders & Dempsey, L.L.P.

(57) ABSTRACT

An ink cartridge (10) for dispensing ink (IK) having a housing (12) with a cavity (22) therein for storing a quantity of ink, and a dispensing port (26) for delivering the ink to an output recordation device, such as a printer. The housing further having one or more additional ports (32, 34) extending through the housing in fluid communication with the cavity, and a self-sealing plug (16) received in one of the additional ports. The self-sealing plug being pierceable by a hollow instrument (H), such as a needle, to form a fluid passage therethrough, the self-sealing plug re-forming a fluid-tight seal in the port upon the removal of the hollow instrument.

22 Claims, 3 Drawing Sheets

SEPTUM SEAL PLUG USED IN INKJET CARTRIDGE

CROSS-REFERENCE TO RELATED APPLICATIONS

This application claims priority from Provisional Application No. 60/239,085 filed on Oct. 6, 2000.

BACKGROUND OF THE INVENTION

This invention relates to the art of cartridges for dispensing ink, and more particularly, to cartridges for dispensing ink that utilize a reduced-pressure area in the cartridge to more efficiently use the capacity of the cartridge, to increase the shelf life and quality of the ink dispensed, and to minimize leakage from the cartridge by minimizing the volume and pressure of extraneous fluids retained in the cartridge and in the ink therein.

Cartridges for dispensing ink have been provided heretofore, and generally are comprised of a housing having a cavity therein for storing a quantity of ink, and a dispensing port extending through the housing from the cavity through which ink may flow. Such a cartridge is operatively associated with an output recordation device, such as a printer. Typically, the printer has a printhead, and the dispensing port is in fluid communication with the printhead so that ink can be transferred from the cavity in the cartridge to an output medium, such as paper.

A housing generally has a top wall, such as a cover, that extends across the top of the housing to fully enclose the cavity. The cover is secured to the housing forming a fluid-tight seal along the seam between the housing and the cover. One or more ports, in addition to the dispensing port, may extend through the housing to permit the ingress and egress of ink or air. Once the cover has been secured to the housing and the cartridge has become a generally closed container, the cartridge is filled with ink. At various stages throughout this filling process, the dispensing port and any other ports will be sealed to prevent leakage and evaporation of the ink.

In ink cartridges of the foregoing character, air may be undesirably retained in the cartridge during the filling process which may reduce the quality of ink that can fit into the cartridge. Air trapped in the ink during the filling process can reduce the storage life of the ink cartridge, and can further lead to a reduction in the quality of output from a printer using such a cartridge. To minimize such effects, ink cartridges are often filled in a reduced-pressure environment. In another filling process, it has been suggested to pressure fill ink cartridges using a degassed ink. A variety of difficulties are encountered when employing such filling procedures. In the former case, the filling operation is made difficult because the reduced-pressure environment often requires expensive equipment to perform the filling operation under these conditions. In the latter case, sealing the port in a conventional manner, such as by plugging or covering the ports, is difficult. Moreover, no provision is made to remove any air that may be inadvertently trapped in the cartridge after it is filled and sealed. As such, it will appreciated that filling cartridges in this manner can be difficult and inefficient, often requiring expensive equipment to effectively perform such filling and sealing operations, and may still lead to a reduction in the quality of ink cartridges. Additionally, even though the ports in the cartridges are sealed after the filling process has been completed, leakage and evaporation of the ink through the ports is often a problem.

BRIEF SUMMARY OF THE INVENTION

In accordance with the present invention, an ink cartridge is provided that avoids or minimizes the problems and difficulties encountered with ink cartridges of the foregoing nature, while promoting and maintaining the desired simplicity of structure, economy of manufacture, ease of assembly, and maintaining the quality of ink stored and dispensed in association with such ink cartridges.

More particularly, an ink cartridge according to the invention includes a housing having a cavity therein for the storage of a quantity of ink. A dispensing port extends through the housing from the cavity such that ink may be dispensed through the port. The housing has a top wall, such as a cover, extending thereacross and enclosing the cavity. The cover is secured to the housing by welding, bonding or adhesive, for example, forming a fluid-tight seal with the housing. One or more additional ports extend through the housing and place the cavity in fluid communication with the ambient atmosphere. A vacuum port is fitted with a self-sealing plug that is pierceable by a hollow instrument, such as a needle, to permit the removal of air through the otherwise fluid-tight vacuum port.

The self-sealing plug is supported on the cartridge adjacent the vacuum port, and insertion of the needle forms a passage for air to flow from the cavity inside the cartridge. The self-sealing plug according to the subject invention includes an elastomeric plug having a body portion and a pair of retaining portions extending therefrom, with the body portion of the self-sealing plug being housed in the vacuum port and forming a fluid-tight seal therewith. The retaining portions of the self-sealing plug extend from the body portion along the housing adjacent opposing ends of the vacuum port. As such, the self-sealing plug is received in the vacuum port forming a fluid-tight seal therewith, and the retaining portions of the self-sealing plug prevent the inadvertent removal of the plug from the vacuum port.

Once the fill operation has been completed, the hollow instrument is removed from the cavity, and the outwardly displaced material of the body portion of the self-sealing plug closes the hole in the plug, eliminating the fluid passage and re-forming a fluid-tight seal between the self-sealing plug and the housing. In this manner, the passage through the seal is closed re-forming a fluid-tight seal, and the reduced-pressure atmosphere within the cavity of the cartridge is maintained.

Accordingly, the present invention provides a cartridge for dispensing ink in which the ink is stored under a reduced pressure relative to the ambient atmosphere, and the cartridge includes a pierceable, self-sealing plug that facilitates removal of air from the cartridge after it has been filled and sealed.

The self-sealing plug advantageously seals after it has been pierced to maintain a seal after air is removed from the filled cartridge.

Another advantage of the invention resides in the provision of an additional seal over the self-sealing plug to assure that air does not seep into the ink cartridge.

Furthermore, an ink cartridge of the foregoing character is comprised of a minimum number of parts and is structurally simple, thereby promoting and maintaining the economical production of the ink cartridge.

Still other benefits and advantages of the invention will become apparent to those skilled in the art upon reading the following detailed description.

DETAILED DESCRIPTION OF THE PREFERRED EMBODIMENT(S)

Figure 1:
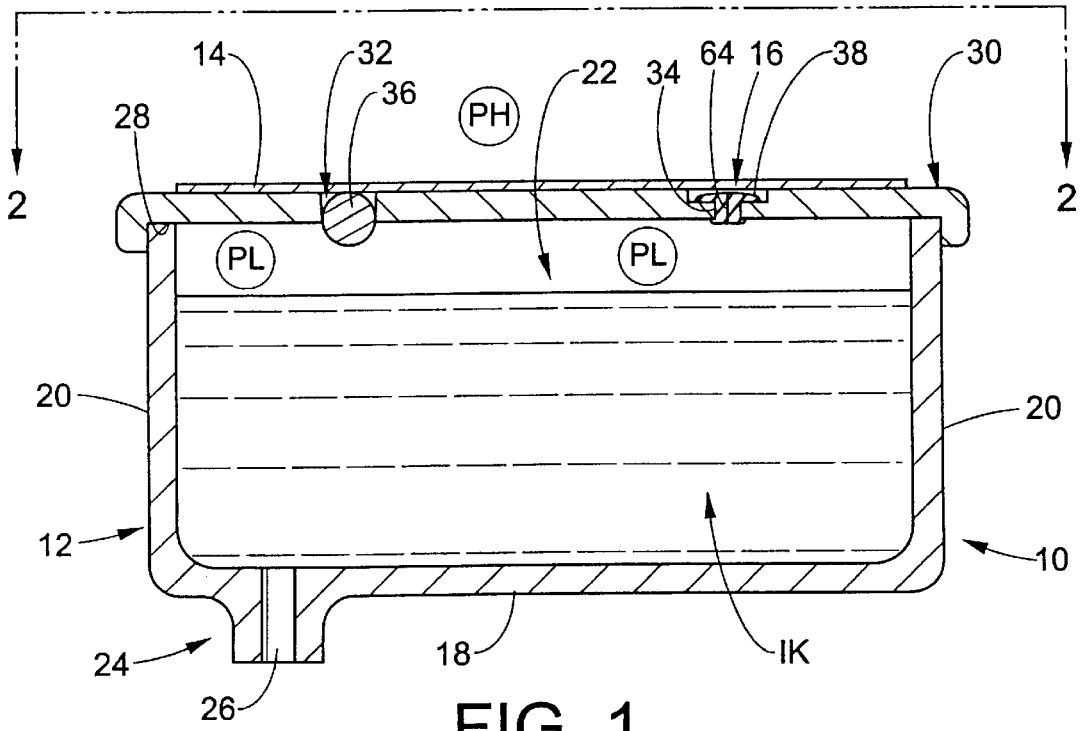
FIG. 1 is a cross-sectional elevation view through one embodiment of an ink cartridge in accordance with the present invention.

Referring now in greater detail to the drawings, wherein the showings are for the purposes of illustrating preferred embodiments of the invention only, and not for the purpose of limiting the invention, FIG. 1 illustrates an ink cartridge 10 having a housing 12, a seal member 14 extending along the exterior of housing 12, and a pierceable, self-sealing plug 16 supported on housing 12 and between the housing and seal member 14.

The housing 12 includes a bottom wall 18 and side walls 20 extending from the bottom wall and defining a cavity 22 therebetween. Extending from bottom wall 18 opposite cavity 22 is an integral tube-like member or chimney 24, and extending through chimney 24 from cavity 22 is a dispensing port 26. Side walls 20 of the housing terminate at top edge 28. A cover 30 extends over and engages the top edge 28 of the housing to enclose cavity 22 in a fluid-tight seal. It will be appreciated that the fluid-tight attachment of the cover to the housing may be made by any one of a variety of suitable methods, such as welding, bonding, or adhesive.

Figure 2:
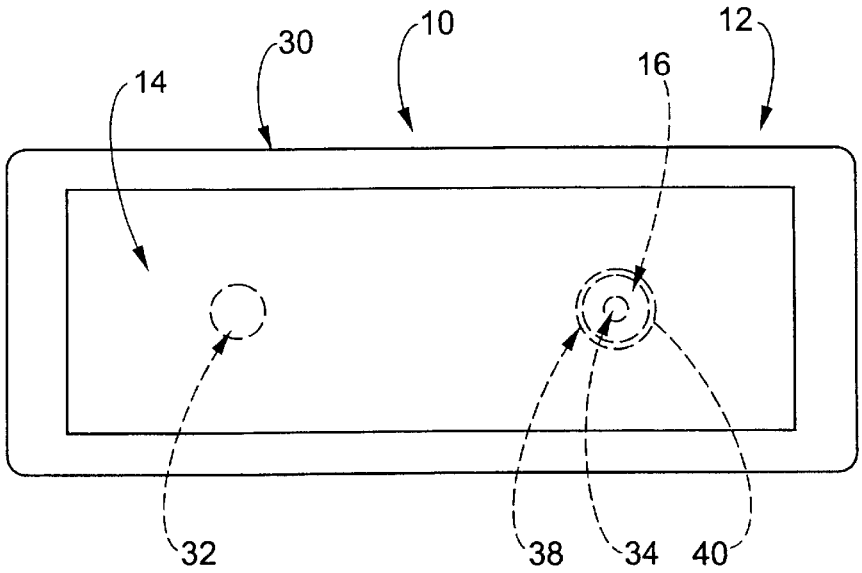
FIG. 2 is a plan view of the ink cartridge shown from the direction of line 2—2 of FIG. 1.

In addition to dispensing port 26, the housing includes a fill port 32 and a vacuum port 34. The fill port 32 may be of any one of a variety of configurations suitable for receiving a fill nozzle for injecting a quantity of ink IK into the cavity 22. The fill port 32 is closed off or sealed by a ball plug 36 after the fill operation has been completed. Vacuum port 34 is shown in FIG. 2 as having a circular shape, but it will be appreciated that vacuum port 34 may adopt one of a variety of shapes or configurations suitable for receiving and forming a fluid-tight seal with the self-sealing plug 16. The cover also preferably includes a recess 38 (FIG. 3) adjacent vacuum port 34 having an inside peripheral wall 40 and a base wall 42.

The self-sealing plug 16 includes a body portion 44 having a base end 46 and a distal end 48. Extending from the base end 46 is a first retaining portion 50, and extending from the distal end 48 is a second retaining portion 52. The body portion 44 is received in the vacuum port 34, such that the base end 46 is adjacent recess 38 and the distal end 48 extends toward the cavity 22. The vacuum port 34 is defined by an inside peripheral wall 54 which, in the present embodiment, is circular. The body portion of the plug preferably has a frustoconical outer surface having a base end diameter and a distal end diameter. The base end diameter is greater than the inside diameter of the vacuum port, such that the base end is compressively positioned within the vacuum port against the inside peripheral wall 54. The distal end diameter of the body portion is less than the inside diameter of the vacuum port such that a clearance 56 exists between the distal end 48 and the inside peripheral wall 54.

Figure 3:
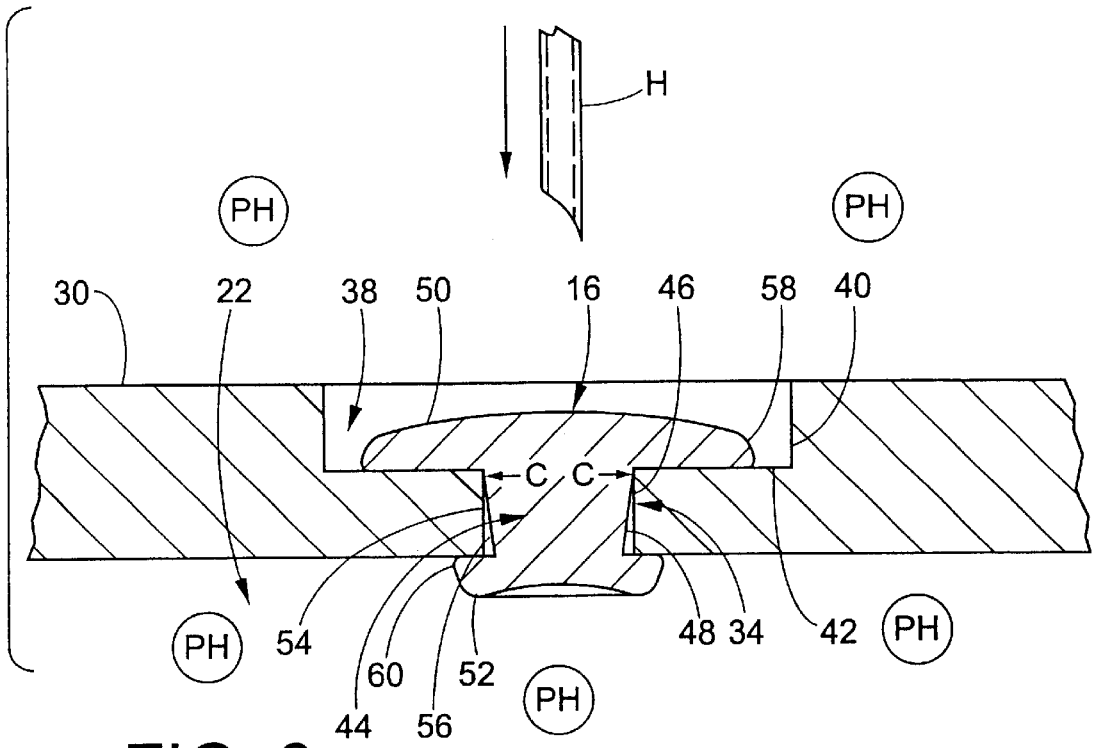
FIG. 3 is an enlarged partial view of the ink cartridge shown in FIG. 1 with the self-sealing plug in an unpierced condition.

As illustrated in FIG. 3, the first retaining portion 50 extends from the base end of the body portion 44 and extends into the cover recess. The first retaining portion is outwardly defined by an outside peripheral wall 58 spaced inwardly of the inside peripheral wall 40 of the recess 38. The first retaining portion 50 engages the base wall 42 and axially retains the self-sealing plug 16 in at least one direction. The second retaining portion 52 extends from the distal end 48 and extends into cavity 22 in the cartridge 10. The second retaining portion has an outside peripheral wall 60 and engages cover 30 to axially retain self-sealing plug 16 against inadvertant pullout in a direction opposite that of the first retaining portion 50. The first and second retaining portions extend outwardly beyond the inside peripheral wall of the vacuum port such that self-sealing plug 16 is advantageously retained within the vacuum port 34. It will be appreciated that these retaining portions may take any suitable shape or size to prevent the inadvertent dislodgment of the self-sealing plug 16 from the vacuum port 34.

Figure 4:
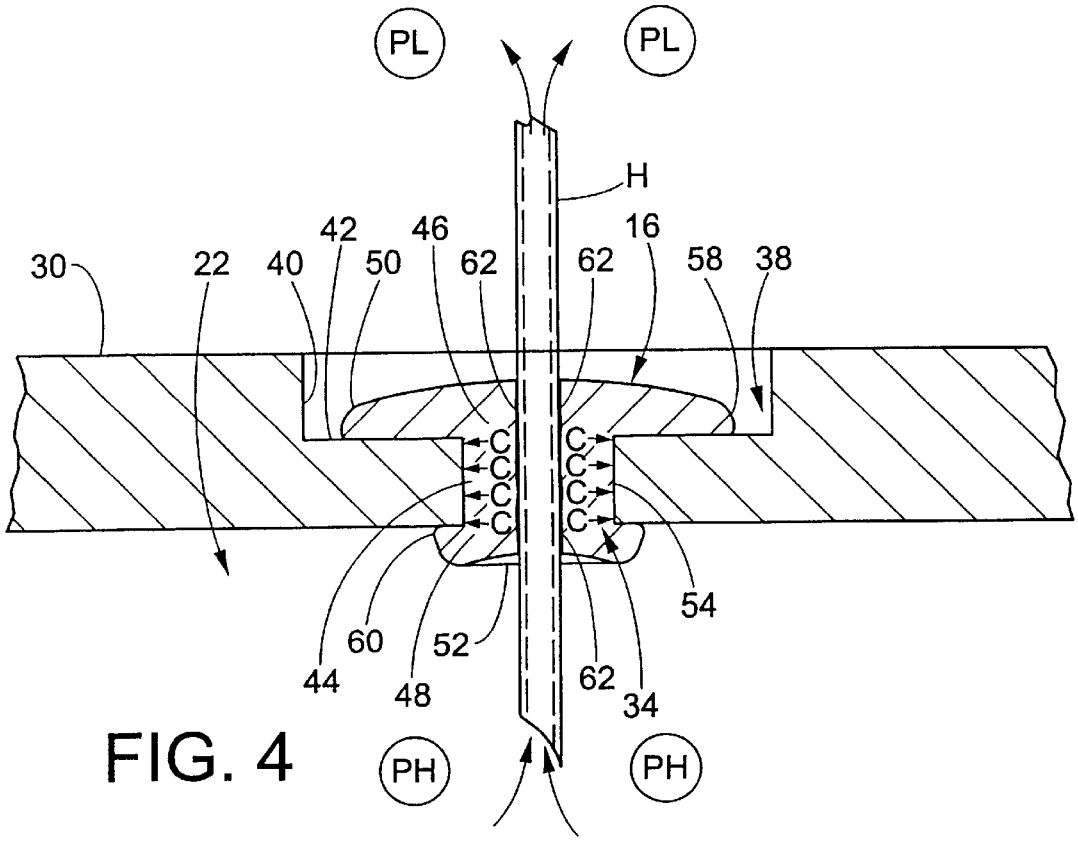
FIG. 4 is an enlarged, partial view of the ink cartridge shown in FIG. 1 with the self-sealing plug pierced by a hollow instrument.

In operation, after the cartridge 10 has been filled with ink IK and all the ports have been plugged or otherwise sealed, the self-sealing plug 16 forms a fluid-tight seal with the vacuum port 34. Air at pressure PH is trapped inside the cavity 22 of the ink cartridge. As is best shown in FIG. 4, a hollow instrument H such as a needle pierces self-sealing plug, and forms a fluid passage therethrough. The instrument H generally does not cut away, sever or otherwise remove material from the self-sealing plug 16. Rather, the instrument H outwardly displaces the plug material (see reference arrows C) such that the instrument H can pass through the body portion. The material of the plug forms a fluid-tight seal 62 about the external surface of instrument H. Due to the outward displacement of the material, clearance 56 is reduced or may be eliminated resulting in a compressive, sealing engagement against the inside peripheral wall 54 of the vacuum port 34.

Figure 5:
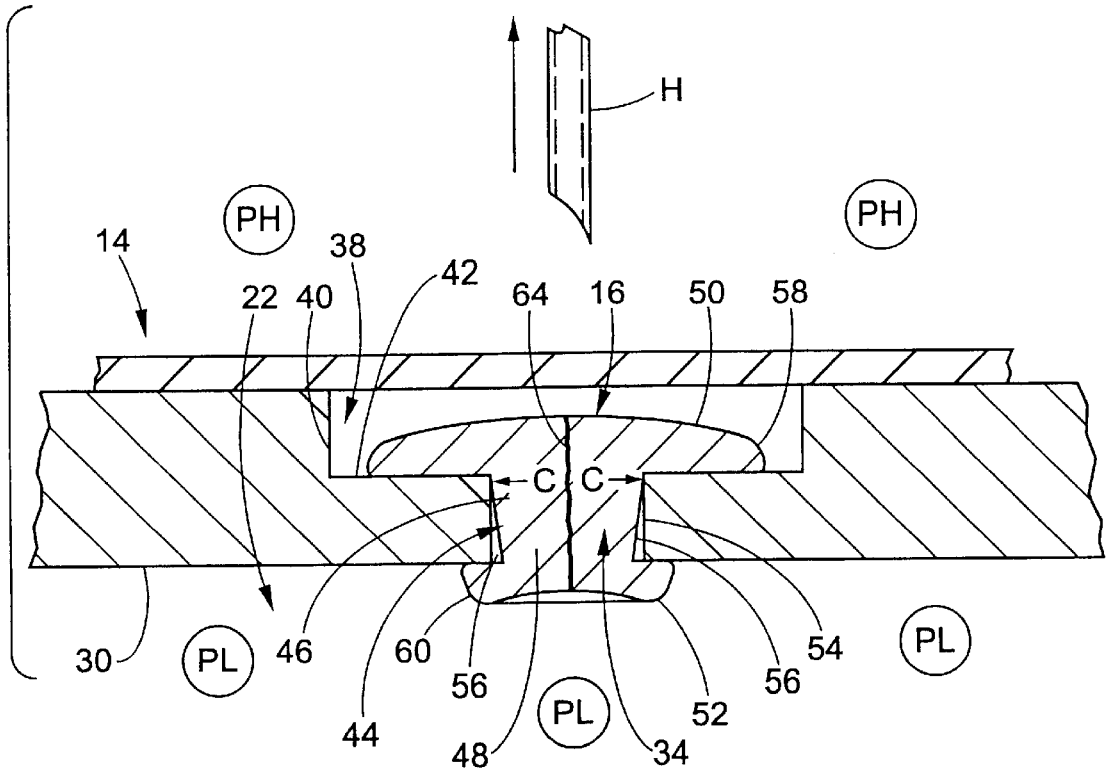
FIG. 5 is an enlarged, partial view of the ink cartridge shown in FIG. 1 with the hollow instrument removed, and the self-sealing plug re-forming a fluid-tight plug in the housing.

With the hollow instrument H creating a fluid passage through the self-sealing plug, and the plug forming a fluid-tight seal about the exterior of the instrument, air trapped within the cavity 22 of the cartridge is removed through the fluid passage. As shown in FIG. 5, the hollow instrument H is then removed from the self-sealing plug 16. Upon removal of the instrument H, the contraction forces formed within the material of the body portion 44 cause a fluid-tight seal to re-form within the self-sealing plug 16. This re-formation of the fluid-tight seal is accomplished automatically. It will be appreciated that the self-sealing plug 16 may be formed from any one of a variety of pierceable, self-sealing materials, and in the embodiment disclosed, self-sealing plug 16 is formed from an elastomeric material, such as silicone.

To minimize any further chance that fill the port 32 or the vacuum port 34 will leak and allow the passage of air into the cavity 22 or permit ink IK to evaporate or otherwise leak from the ports, the seal member 14 extends across cover 30 of housing 12 to cover these ports. The plastic, an elastomer, or a metallic foil seal member 14 may be welded, bonded or glued to cover 30.

While considerable emphasis has been placed herein on the structures and structural interrelationships between the features of the embodiment disclosed, it will be appreciated that other embodiments of the invention can be made and that many changes can be made in the embodiments illustrated and described without departing from the principles of the invention. Accordingly, it is to be distinctly understood that the foregoing descriptive matter is to be interpreted merely illustrative of the present invention and not as a limitation.

Having thus described the preferred embodiment(s), the invention is now claimed to be:

1. A cartridge for dispensing ink in association with an output recordation device, said cartridge comprising:

a housing having a bottom wall, side walls and a cover defining a cavity therein for storing a quantity of ink and a dispensing port passing through said bottom wall and communicating with said cavity through said housing, said housing having a vacuum port extending through said cover for selectively placing said cavity in fluid communication with ambient; and a self-sealing plug received in said vacuum port of said cover and forming a fluid-tight seal therein, said plug being self-sealing such that upon the removal of an instrument that has pierced said seal to selectively permit the transmission of fluid therethrough said plug re-forms an air and fluid-tight seal in said vacuum port.

2. A cartridge as in claim 1, wherein said plug has a first portion having a first cross-sectional area being greater than a cross-sectional area of said vacuum port.

3. A cartridge as in claim 2, wherein said first portion of said plug is compressively positioned within said vacuum port of said cover, and said plug includes a second portion having a second cross-sectional area of said plug, and said second cross-sectional area of said plug is substantially greater than said first cross-sectional area of said plug.

4. A cartridge as in claim 3, wherein said plug is formed from silicone.

5. A cartridge as in claim 3, wherein said housing has an interior surface at least partially defining said cavity, an exterior surface, and a recess extending inwardly from said exterior surface adjacent said vacuum port, and said second portion of said plug extends into said recess.

6. A cartridge as in claim 5 further comprising a seal member extending along said exterior surface of said housing to at least partially cover said recess therein.

7. A cartridge as in claim 6, wherein said seal member is formed from foil.

8. A cartridge as in claim 3, wherein said cover has an interior surface, an exterior surface, and a recess extending inwardly from said exterior surface adjacent said vacuum port, and said second portion of said plug extends into said recess.

9. A cartridge as in claim 8 further comprising a seal member extending along said exterior surface of said cover to at least partially cover said recess therein.

10. A cartridge as in claim 9, wherein said seal member is formed from foil.

11. A cartridge for dispensing ink in association with an output recordation device, said cartridge comprising:

a housing having a cavity therein for storing a quantity of ink and a dispensing port communicating with said cavity through said housing, said housing having a vacuum port extending therethrough for selectively placing said cavity in fluid communication with ambient; and a self-sealing plug received in said vacuum port and forming a fluid-tight seal therein, said plug being self-sealing such that upon the removal of an instrument that has pierced said seal to selectively permit the transmission of fluid therethrough said plug re-forms a fluid-tight seal in said vacuum port; wherein said plug has a first portion having a first cross-sectional area being greater than a cross-sectional area of said vacuum port, said first portion of said plug is compressively positioned within said vacuum port of said cover, and said plug includes a second portion having a second cross-sectional area of said plug, and said second cross-sectional area of said plug is substantially greater than said first cross-sectional area of said plug; and said plug includes a third portion extending from said first portion opposite said second portion, said third portion having a third cross-sectional area, and said third cross-sectional area being greater than said first cross-sectional area.

12. A cartridge for dispensing ink in association with an output recordation device, said cartridge comprising:

a housing having a cavity therein for storing a quantity of ink and a dispensing port communicating with said cavity through said housing, said housing having a vacuum port extending therethrough for selectively placing said cavity in fluid communication with ambient; and a self-sealing plug received in said vacuum port and forming a fluid-tight seal therein, said plug being self-sealing such that upon the removal of an instrument that has pierced said seal to selectively permit the transmission of fluid therethrough said plug re-forms a fluid-tight seal in said vacuum port; wherein said plug has a first portion having a first cross-sectional area being greater than a cross-sectional area of said vacuum port, said first portion of said plug is compressively positioned within said vacuum port of said cover, and said plug includes a second portion having a second cross-sectional area of said plug, and said second cross-sectional area of said plug is substantially greater than said first cross-sectional area of said plug; and said first portion of said plug has a frustoconical surface having a base end cross-sectional area and a distal end cross-sectional area, said base end cross-sectional area being greater than said cross-sectional area of said vacuum port.

13. A cartridge as in claim 12, wherein said plug includes a third portion adjacent said distal end thereof having a third cross-sectional area, and said third cross-sectional area being greater than said first cross-sectional area of said plug.

14. A cartridge as in claim 13, wherein said housing has an interior surface at least partially defining said cavity, an exterior surface, and a recess extending inwardly from said exterior surface adjacent said vacuum port, and said second portion of said plug extending into said recess.

15. A cartridge as in claim 14 further comprising a seal member extending along said exterior surface of said housing to at least partially cover said recess therein.

16. A cartridge as in claim 15, wherein said seal member is formed from foil.

17. A cartridge for dispensing ink in association with an output recordation device, said cartridge comprising:

a housing having a cavity therein for storing a quantity of ink and a dispensing port communicating with said cavity through said housing, said housing having a vacuum port extending therethrough for selectively placing said cavity in fluid communication with ambient; and a self-sealing plug received in said vacuum port and forming a fluid-tight seal therein, said plug being self-sealing such that upon the removal of an instrument that has pierced said seal to selectively permit the transmission of fluid therethrough said plug re-forms a fluid-tight seal in said vacuum port; wherein said plug has a first portion having a first cross-sectional area being greater than a cross-sectional area of said vacuum port, said first portion of said plug is compressively positioned within said vacuum port of said cover, and said plug includes a second portion having a second cross-sectional area of said plug, and said second cross-sectional area of said plug is substantially greater than said first cross-sectional area of said plug; and said first portion of said plug has a frustoconical surface having a base end cross-sectional area and a distal end cross-sectional area, said base end cross-sectional area being greater than said cross-sectional area of said vacuum port.

18. A cartridge as in claim 17, wherein said plug includes a third portion adjacent said distal end thereof having a third cross-sectional area, and said third cross-sectional area being greater than said first cross-sectional area of said plug.

19. A cartridge as in claim 18, wherein said cover has an interior surface, an exterior surface, and a recess extending inwardly from said exterior surface adjacent said vacuum port, and said second portion of said plug extending into said recess.

20. A cartridge as in claim 19, further comprising a seal member extending along said exterior surface of said cover to at least partially cover said recess therein.

21. A cartridge as in claim 20, wherein said seal member is formed from foil.

22. A self-sealing plug for use in association with a cartridge for dispensing ink, said plug comprising:

a first body portion extending in a longitudinal direction between a base end and a distal end, and being laterally defined by a first outside peripheral wall;

a second body portion extending longitudinally from said distal end of said first body portion, said second body portion being laterally defined by a second outside peripheral wall, said second outside peripheral wall having a greater length than said first outside peripheral wall; and;

a third body portion extending longitudinally from said base end of said first body portion, said third body portion being laterally defined by a third outside peripheral wall, and said third outside peripheral wall having a greater length than said first outside peripheral wall.

* * * * *